US010012016B2

(12) United States Patent
Li et al.

(10) Patent No.: US 10,012,016 B2
(45) Date of Patent: Jul. 3, 2018

(54) TOP-HUNG CASEMENT WINDOW

(71) Applicant: Zengbang Li, Shenzhen, Guangdong (CN)

(72) Inventors: Shupeng Li, Guangdong (CN); Zhiguo Liu, Guangdong (CN)

(73) Assignee: Zengbang Li, Shenzhen (CN)

( * ) Notice: Subject to any disclaimer, the term of this patent is extended or adjusted under 35 U.S.C. 154(b) by 0 days.

(21) Appl. No.: 15/435,321

(22) Filed: Feb. 17, 2017

(65) Prior Publication Data

US 2017/0159337 A1 Jun. 8, 2017

Related U.S. Application Data

(63) Continuation of application No. PCT/CN2014/087652, filed on Sep. 28, 2014.

(51) Int. Cl.
*E05D 15/22* (2006.01)
*E05D 15/02* (2006.01)
*E06B 3/36* (2006.01)

(52) U.S. Cl.
CPC ..... *E05D 15/02* (2013.01); *E06B 3/36* (2013.01); *E05Y 2600/45* (2013.01); *E05Y 2600/46* (2013.01); *E05Y 2600/51* (2013.01); *E05Y 2900/148* (2013.01)

(58) Field of Classification Search
CPC ..... E05D 15/02; E06B 3/56; E05Y 2900/148
USPC ..... 49/176–182, 192, 193
See application file for complete search history.

(56) References Cited

U.S. PATENT DOCUMENTS 3,994,093 A * 11/1976 Mayer ..... E05D 15/52 49/192
4,208,838 A * 6/1980 Kleine ..... E05D 15/5208 49/192
4,420,905 A * 12/1983 Kucharczyk ..... E05C 9/002 292/139
4,541,200 A * 9/1985 Gartner ..... E05C 17/28 49/192
4,637,165 A * 1/1987 Schneider ..... E05D 15/5208 49/192
4,739,583 A * 4/1988 Tonsmann ..... E05D 15/5208 49/192

(Continued)

FOREIGN PATENT DOCUMENTS

DE 3430897 C1 * 11/1985 ..... E05D 15/5208
EP 515931 A1 * 5/1992
GB 2067638 A * 7/1981 ..... E05D 15/5253

*Primary Examiner* — Jerry E Redman

(57) ABSTRACT

The present invention is applicable to the field of door and window technologies, and provides a top-hung casement window, including a window frame, a casement sash, and a hinge assembly. The hinge assembly includes a first hinge, a second hinge, a pivot, a connecting piece, a swing part, and a vertical limiting part. During the turning of the casement sash, the swing part swings only around the vertical limiting part, with a limited motion space. Therefore, the swing part and the casement do not shake easily. When the casement sash is open, the position of the vertical limiting part and casement sash does not change. Because all force of gravity of the casement sash is transferred to the window frame through the vertical limiting part, the bottom of the casement sash does not rub the window frame, avoiding generation of noise and abrasion of components of the hung window.

15 Claims, 8 Drawing Sheets

(56) References Cited

U.S. PATENT DOCUMENTS

| | | | | |
|---|---|---|---|---|
| 4,928,428 | A * | 5/1990 | Gebhardt | E05D 15/52 49/192 |
| 5,052,079 | A * | 10/1991 | Vosskotter | E05D 15/32 16/367 |
| 5,081,741 | A * | 1/1992 | Aumercier | E05D 15/30 16/238 |
| 5,226,256 | A * | 7/1993 | Fries | E05B 47/0012 49/13 |
| 6,421,877 | B1 * | 7/2002 | Mih | E05D 7/0423 16/238 |
| 7,013,604 | B1 * | 3/2006 | Moody | E05C 9/10 49/341 |
| 8,161,683 | B2 * | 4/2012 | Van Parys | E05D 15/52 292/141 |
| 8,240,089 | B2 * | 8/2012 | Lambertini | E05D 15/565 49/226 |
| 8,281,519 | B2 * | 10/2012 | Lambertini | E05C 9/24 49/209 |
| 8,528,255 | B2 * | 9/2013 | Lambertini | E05C 9/063 49/192 |
| 9,512,658 | B2 * | 12/2016 | Balbo Di Vinadio | E05D 15/44 |
| 2005/0022941 | A1 * | 2/2005 | Di Vinadio | E05C 9/20 160/15 |
| 2005/0246979 | A1 * | 11/2005 | Balbo Di Vinadio | E05D 15/5208 52/204.1 |
| 2008/0016774 | A1 * | 1/2008 | Vinadio | E05C 9/063 49/192 |
| 2008/0016782 | A1 * | 1/2008 | Balbo Di Vinadio | E05D 15/5208 49/506 |
| 2009/0013605 | A1 * | 1/2009 | Seo | E05D 15/565 49/279 |

* cited by examiner

TOP-HUNG CASEMENT WINDOW

CROSS REFERENCE TO RELATED APPLICATIONS

This application is a continuation of PCT Application No. PCT/CN2014/087652 filed on Sep. 28, 2014, the entire contents of which are incorporated herein by reference.

TECHNICAL FIELD

The present invention relates to the field of door and window technologies, and in particular, to a top-hung casement window.

BACKGROUND

A top-hung casement window can be opened outward horizontally and opened in a hanging manner as well. On a top-hung casement window in the prior art, a top-hung turning assembly is mounted at the upper edge of a window to implement turning and hanging operation of the casement sash; and a side-hung backward turning assembly is mounted at a bottom of the window sash and frame to implement closing operation on the opened sash.

As shown in FIG. 1, the top-hung turning assembly includes a turning block 10, a turning block slot 101, and a five-link sliding support 20. The turning block 10 cooperates with the turning block slot 101 to form a hinge structure; the turning block slot 101 is fixedly connected to an upper edge of the window frame; the turning block 10 goes through the turning block slot 101 and is fixedly connected to the top surface of the five-link sliding support 20; the bottom surface of the five-link sliding support 20 is fixedly connected to the upper edge of the casement sash; the turning block 10, the turning block slot 101, and the five-link sliding support 20 are connected by using a screw 30. The turning block 10 is mounted at the upper edge of the window frame, and can rotate around the turning block slot 101 relative to the window frame. The five-link sliding support 20 is mounted at the upper edge of the window edge to implement turning when the casement sash is top-hung. The casement sash is hung by using the turning block slot 101 and the turning block 10.

As shown in FIG. 2, the side-hung backward turning assembly includes the five-link sliding support 20 and an inclined shear bar 40, where the five-link sliding support 20 is mounted at a lower edge of the window frame and the inclined shear bar 40 is mounted at the lower edge of the casement sash. The five-link sliding support 20 and the inclined shear bar 40 are riveted so that they can rotate.

When the casement sash is open, the five-link sliding support 20 in the top-hung backward turning assembly and the five-link sliding support 20 in the side-hung turning assembly bear the casement sash and enable the casement sash to slide around the window frame at an angle of 90 degrees. However, to ensure that the casement sash can be turned when the casement sash is top-hung, the five-link sliding support 20 have to swing slightly up and down in vertical direction; otherwise, the casement sash cannot be opened in top-hung position to a certain angle. Therefore, in the structure of the top-hung backward turning assembly, the casement sash is unstable in a hanging position and will shake easily. In addition, due to heavy force of gravity, the casement sash presses the five-link sliding support 20 in the side-hung turning assembly and thus the casement sash is easy to droop down. Consequently, the casement sash is more and more difficult to be opened and closed, friction force increased, and components contacting the five-link sliding support 20 are abraded, while noise is generated, shortening the life span of the product.

SUMMARY

The technical issue to be solved by the present invention is to provide a top-hung casement window to solve the problem in the prior art in which a casement sash of a top-hung casement window easily shakes when the casement sash is hung, noise is generated when the casement sash is open, and components of the casement sash are abraded when the casement sash is hung down.

The present invention is implemented as follows: A top-hung casement window includes a window frame, a casement sash, and a hinge assembly. The hinge assembly includes a first hinge, a second hinge, a pivot, a connecting piece, a swing part, and a vertical limiting part. The first hinge includes a hinge portion and a connecting portion, where the hinge portion is disposed around the pivot, and the connecting portion is fixedly connected to the window frame. The second hinge also includes a hinge portion and a connecting portion, where the hinge portion is disposed around the pivot, and the connecting portion is fixedly connected to the connecting piece. The vertical limiting part is provided with a fixing portion and a bearing portion; the swing part is provided with a through-hole and a groove; the bearing portion is embedded into the groove, and the fixing portion extends from the through-hole and is fixedly connected to the connecting piece; the swing part may rotate around the bearing portion through the groove; and the swing part is fixedly connected to the top of the casement sash.

Further, a shape of the bearing portion matches a shape of the groove.

Further, the top surface of the bearing portion is an arc surface.

Further, two grooves are provided at the bottom of the swing part, and the through-hole is provided at the bottom of each groove.

Further, the connecting piece is L-shaped and includes a horizontal portion and a vertical portion, where the horizontal portion is fixedly connected to the fixing portion of the vertical limiting part and the vertical portion is fixedly connected to the connecting portion of the second hinge.

Further, the fixing portion of the vertical limiting part and the connecting piece are riveted.

Further, the hinge assembly further includes a first fastening part and a first left-right adjusting screw, where the first fastening part is fixedly connected to the top of the casement sash and the swing part is connected to the first fastening part by using the first left-right adjusting screw.

Further, the hinge assembly further includes a fixing bracket; the first fastening part is provided with an embedded groove in a horizontal direction; one end of the fixing bracket is fixedly connected to the swing part; and the other end of the fixing bracket goes through the embedded groove and is fixedly connected to the casement sash by using a screw.

Further, the hinge assembly further includes a reinforcing part, where the reinforcing part is fixedly connected to the connecting portion of the first hinge and the top of the reinforcing part is fixedly connected to the window frame.

Further, a hanger is provided on the top of the reinforcing part, and a slot is provided in the window frame, where the hanger is latched into the slot.

Further, the hinge assembly further includes a hinge base, where the hinge base is fixedly disposed on the window frame and contacts the bottom of the first hinge.

Further, the hinge base is provided with a threaded through-hole in a vertical direction, and an up-down adjusting screw goes through the threaded through-hole.

Further, the top-hung casement window further includes a lock lever and a lock base, where the lock lever is fixedly disposed on the top of the casement sash and the lock base is fixedly disposed on the window frame; a first latching knob and a second latching knob are extended up from the lock lever and distributed at an interval; a first slot and a second slot are disposed at an interval on the lock base; when the casement sash is open, the lock base is located between the first latching knob and the second latching knob; when the casement sash is closed, the first latching knob is latched into the first slot; and when the casement sash is top-hung, the second latching knob is latched into the second slot.

Further, the second hinge is also fixedly disposed at the bottom of the casement sash; and correspondingly, the first hinge is fixedly disposed on the window frame, and the first hinge and the second hinge are hinged through the pivot.

The top-hung casement window further includes a support arm, a second fastening part, and a second left-right adjusting screw, where the second fastening part is fixedly connected to the bottom of the casement sash, and the support arm is fixedly connected to the second hinge at the bottom of the casement sash; and the support arm is connected to the second fastening part by using the second left-right adjusting screw.

Compared with the prior art, the present invention has the following benefits: In the present invention, the casement sash is open by using the first hinge, the second hinge, and the pivot, and the casement sash is hung and turned by using the connecting piece, the swing part, and the vertical limiting part. During the turning of the casement sash, the swing part is always clamped between the connecting piece and the vertical limiting part, and the swing part swings only around the vertical limiting part, with a limited motion space. Therefore, the swing part and the casement sash fixedly connected to the swing part do not shake easily. In addition, when the casement sash is open, the position of the vertical limiting part does not change, and nor does the position of the casement sash in the vertical direction change. Because all force of gravity of the casement sash is transferred to the window frame through the vertical limiting part on the top of the casement sash, the stress structure design on the top of the casement sash ensures that the bottom of the casement sash does not rub the window frame, thereby avoiding generation of noise and abrasion of components of the hung window.

DESCRIPTION OF EMBODIMENTS

Figure 1:
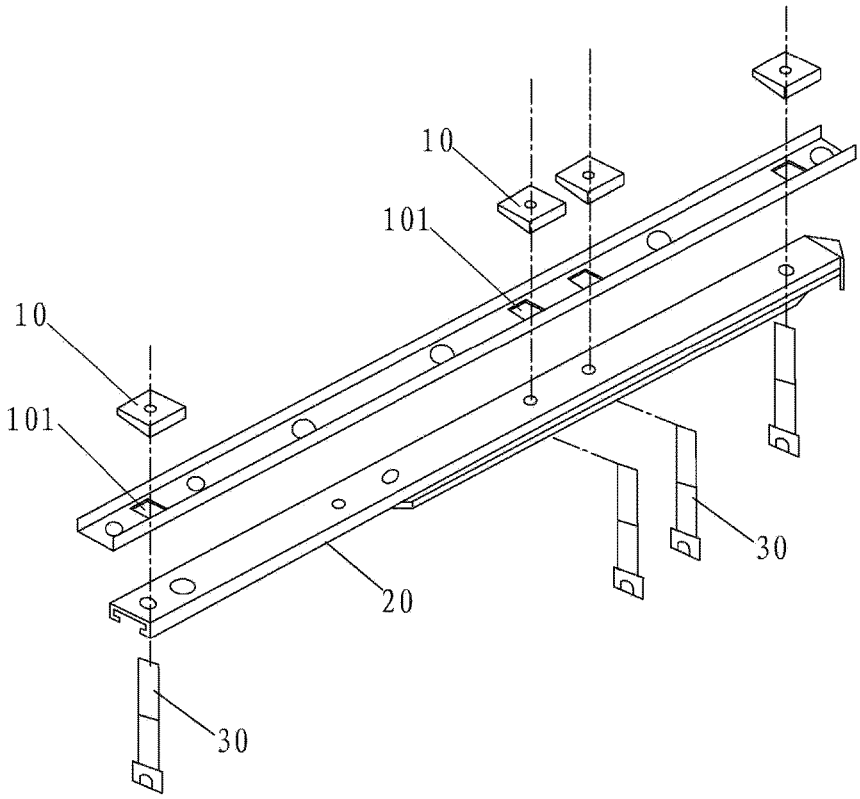
FIG. 1 (Prior Art)
FIG. 1 is a schematic diagram of a breakdown structure of a top-hung back swing assembly of a top-hung casement window in the prior art.
Figure 2:
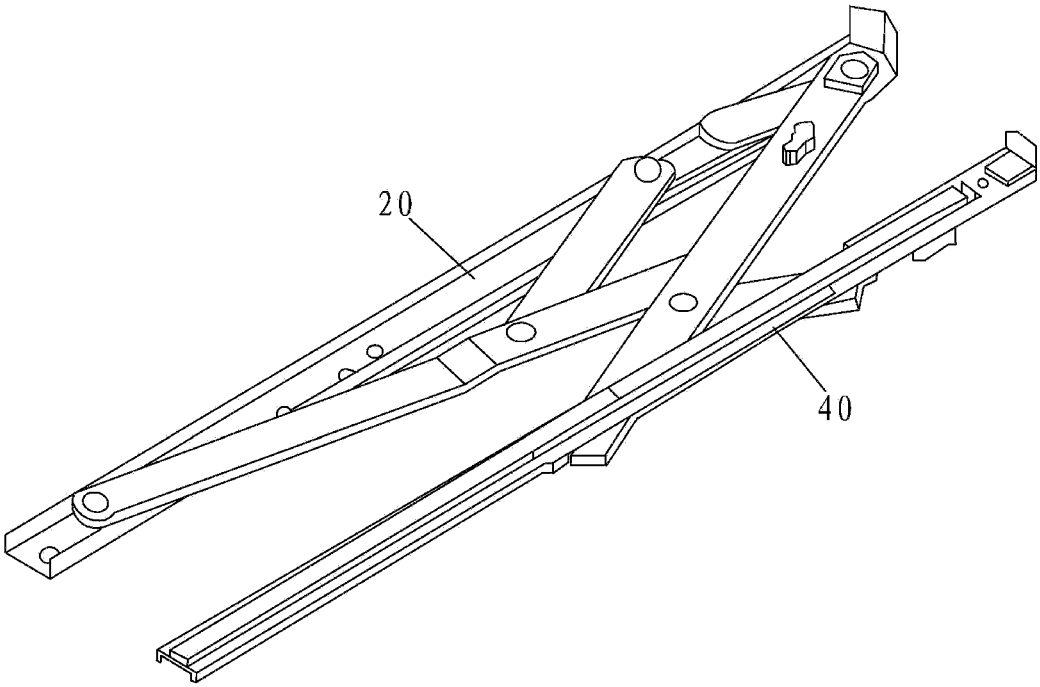
FIG. 2 (Prior Art)
FIG. 2 is a schematic diagram of a three-dimensional structure of a side-hung back swing assembly of a top-hung casement window in the prior art.
Figure 3:
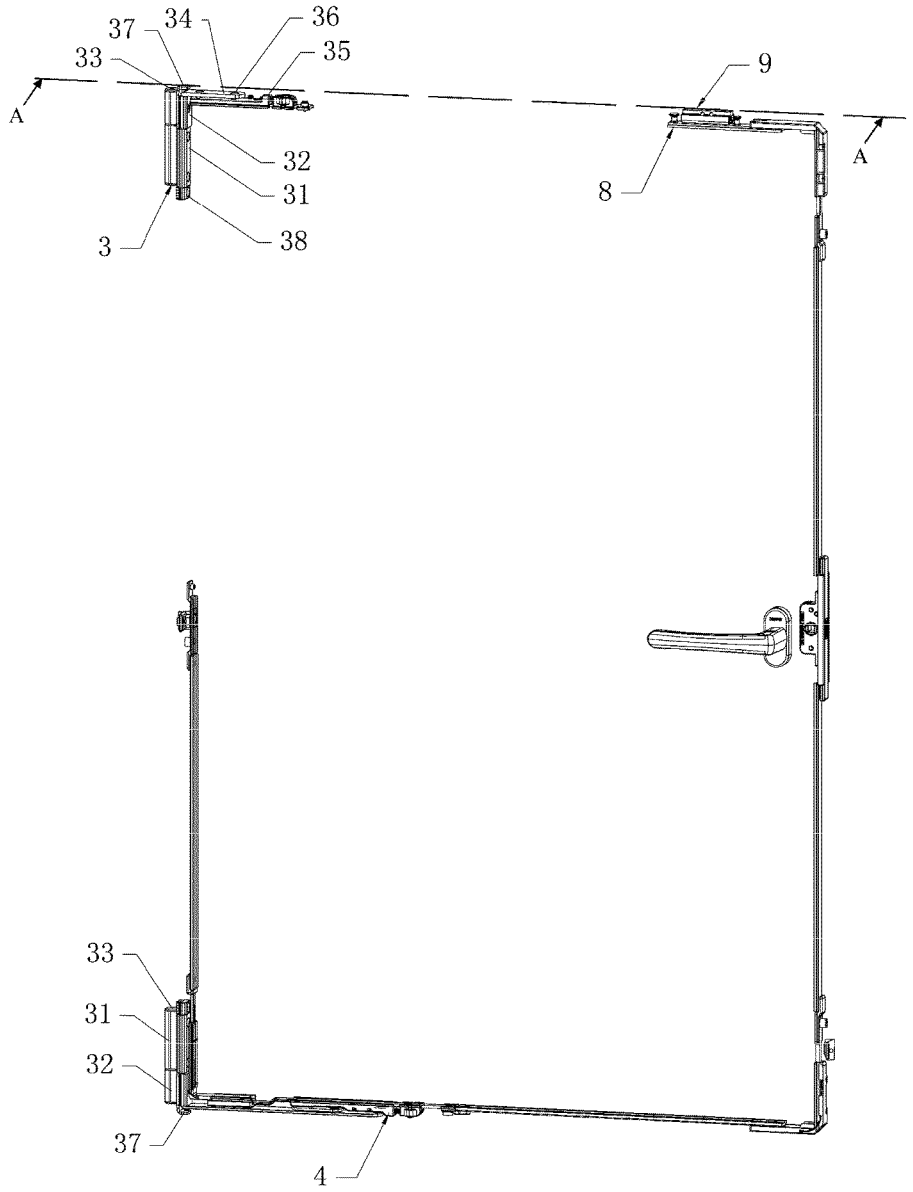
FIG. 3 is a schematic diagram of a three-dimensional structure of an accessory of a top-hung casement window according to an embodiment of the present invention.
Figure 4:
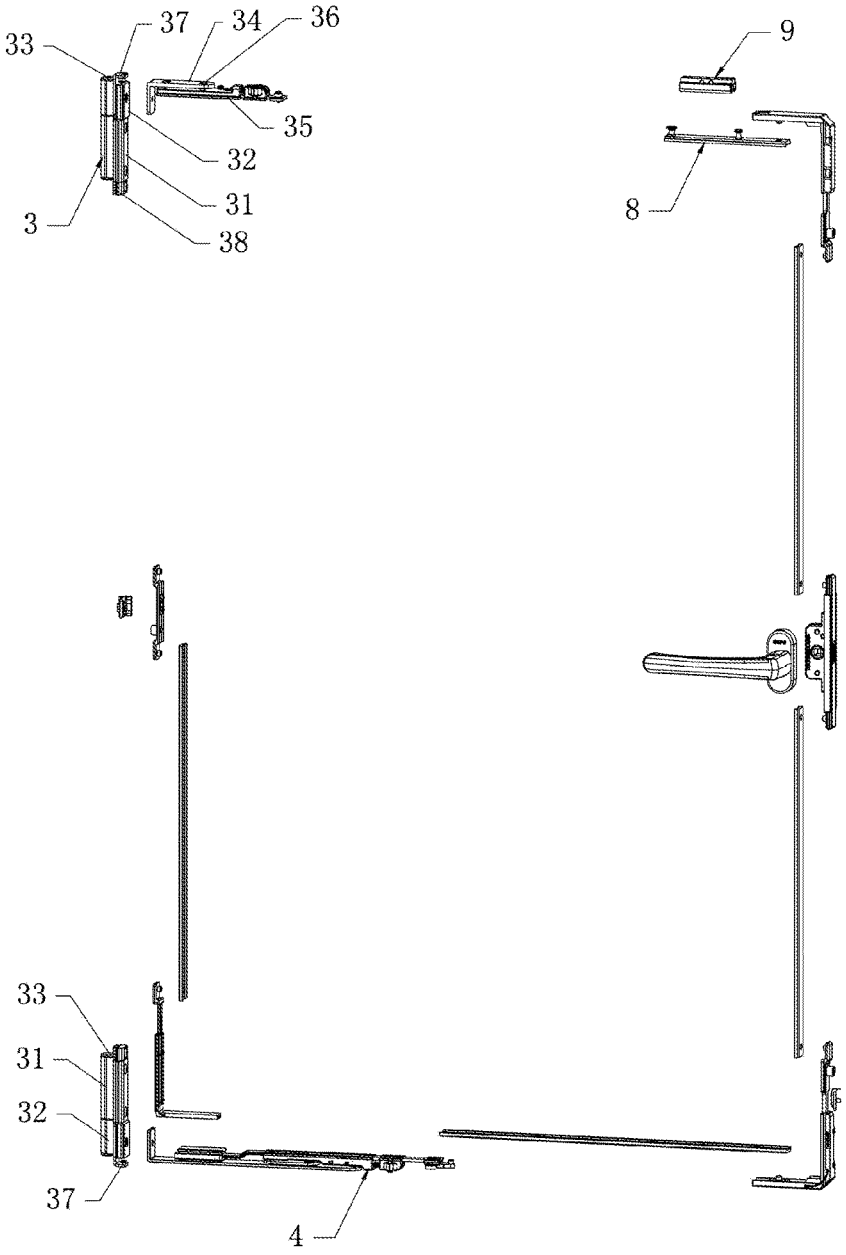
FIG. 4 is a schematic diagram of a breakdown structure of the accessory of the top-hung casement window shown in FIG. 3.
Figure 5:
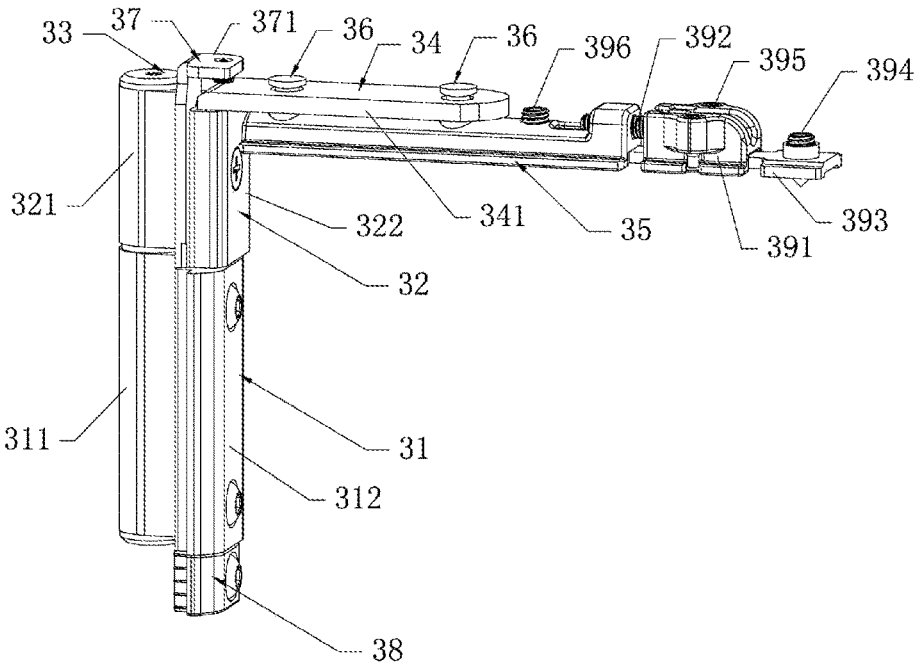
FIG. 5 is a schematic diagram of a three-dimensional structure of a hinge assembly shown in FIG. 3.
Figure 6:
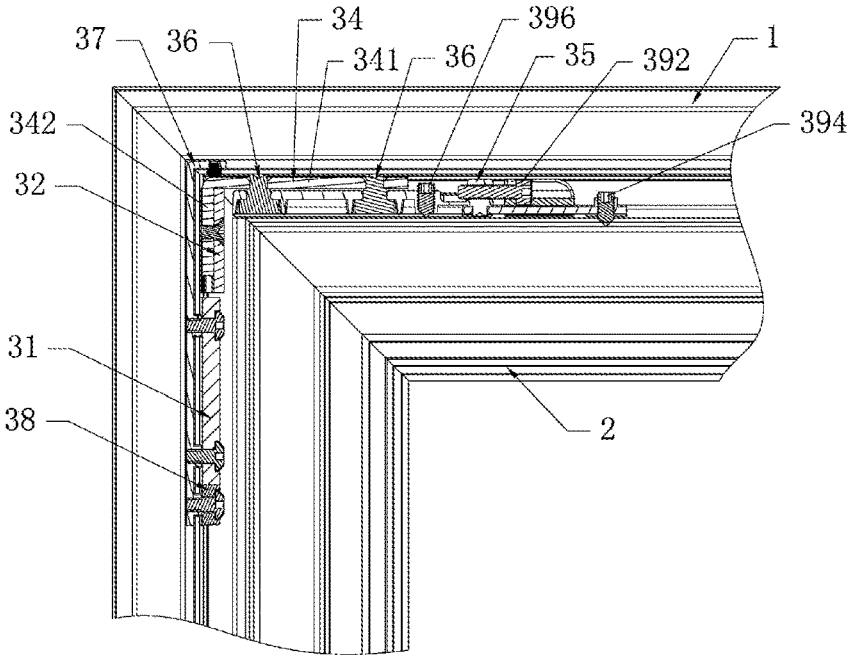
FIG. 6 shows the hinge assembly shown in FIG. 3 in a cross-sectional view along a section line A-A is mounted on the hung window.

To make the technical issue to be solved by the present invention, technical solutions, and benefits of the present invention more comprehensible, the following further describes the present invention in detail with reference to the accompanying drawings and embodiments. It is understandable that the specific embodiments described herein are only used to explain the present invention and are not intended to limit the present invention.

FIG. 3 to FIG. 6 illustrate an exemplary embodiment of the present invention. A top-hung casement window includes a window frame 1, a casement sash 2, and a hinge assembly 3, where the hinge assembly 3 includes a first hinge 31, a second hinge 32, a pivot 33, a connecting piece 34, a swing part 35, and a vertical limiting part 36.

The first hinge 31 includes a hinge portion 311 and a connecting portion 312, where the hinge portion 311 is disposed around the pivot 33 and the connecting portion 312 is fixedly connected to the window frame 1. The second hinge 32 also includes a hinge portion 321 and a connecting portion 322, where the hinge portion 321 is disposed around the pivot 33 and the connecting portion 322 is fixedly connected to the connecting piece 34, so that the casement sash 2 can rotate around the window frame 1.

Figure 7:
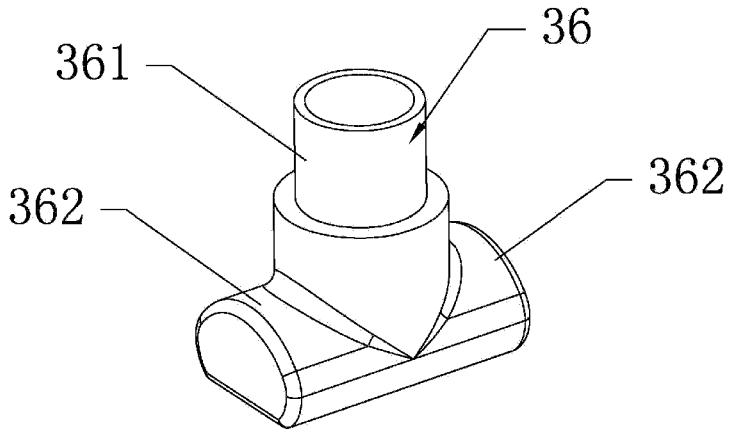
FIG. 7 is a schematic diagram of a three-dimensional structure of a vertical limiting part shown in FIG. 3.
Figure 8:
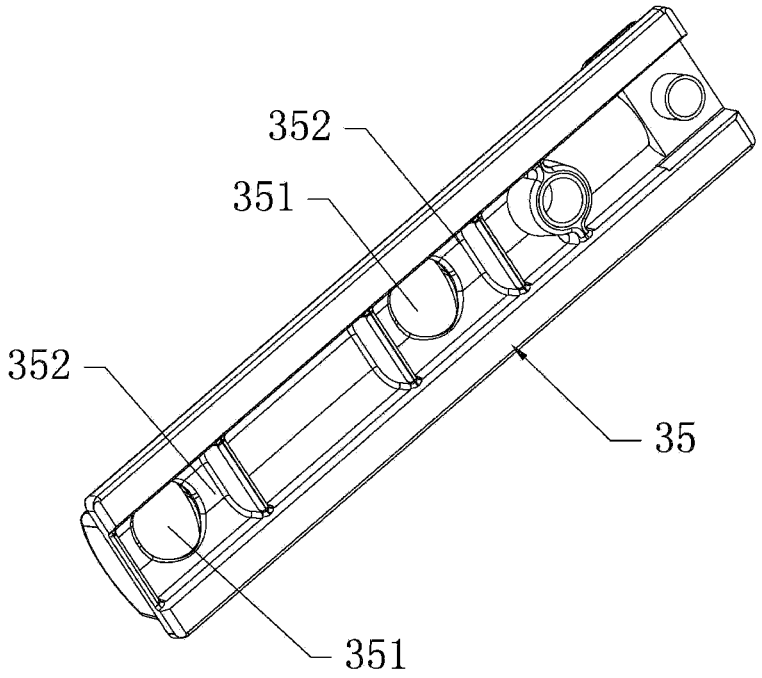
FIG. 8 is a schematic diagram of a three-dimensional structure of a swing part shown in FIG. 3.

With reference to FIG. 7 and FIG. 8, the vertical limiting part 36 is provided with a fixing portion 361 and a bearing portion 362; the swing part 35 is provided with a through-hole 351 and a groove 352; the bearing portion 362 is embedded in the groove 352, and the fixing portion 361 extends from the through-hole 351 and is fixedly connected to the connecting piece 34; the swing part 35 is fixedly connected to the top of the casement sash 2, and the swing part 35 can rotate around the bearing portion 362 through the groove 352, so that the casement sash 2 can implement turning relative to the connecting piece 34. To match the right angle of the window frame 1 and the casement sash 2, the connecting piece 34 is L-shaped. The connecting piece 34 includes a horizontal portion 341 and a vertical portion 342, where the horizontal portion 341 is fixedly connected to the fixing portion 361 of the vertical limiting part 36. In the embodiment, the fixing portion 361 of the vertical limiting part 36 and the connecting piece 34 are riveted, and the vertical portion 342 is fixedly connected to the connecting portion 322 of the second hinge 32.

To ensure that the swing part 35 can be hung and turned more smoothly and stably, the top surface of the bearing portion 362 is an arc surface disposed on both sides of the fixing portion 361. Two grooves 352 are provided at the bottom of the swing part 35, and the through-hole 361 is provided at the bottom of each groove 352. The shape of the bearing portion 362 matches the shape of the groove 352, and the bearing portion 362 is embedded in the groove. The casement sash 2 does not move horizontally or up and down when the casement sash 2 is open, hung and turned, so that the casement sash 2 can always keep firm in various states, thereby avoiding hanging down of the casement sash due to a designed gap of an accessory structure.

In the embodiment, the casement sash 2 is open by using the first hinge 31, the second hinge 32, and the pivot 33, and the casement sash 2 is hung and turned by using the connecting piece 34, the swing part 35, and the vertical limiting part 36. During the turning of the casement sash 2, the swing part 35 is always clamped between the connecting piece 34 and the vertical limiting part 36, and the swing part 35 swings only around the vertical limiting part 36, with a limited motion space. Therefore, the swing part 35 and the casement sash 2 fixedly connected to the swing part 35 do not shake easily. In addition, when the casement sash 2 is open, the position of the vertical limiting part 36 does not change, and the position of the casement sash 2 in the vertical direction does not change. Because all force of gravity of the casement sash 2 is transferred to the window frame 1 through the vertical limiting part on the top of the casement sash 2, the bottom of the casement sash 2 does not rub the window frame 1, thereby avoiding generation of noise and abrasion of components of the hung window.

Specifically, to ensure that the first hinge 31 can be mounted on the window frame 1 more firmly, the hinge assembly 3 provided by the embodiment further includes a reinforcing part 37 and a hinge base 38, where the reinforcing part 37 is fixedly connected to the connecting portion 312 of the first hinge 31, and the top of the reinforcing part 37 is fixedly connected to the window frame 1. The hinge base 38 is fixedly disposed on the window frame 1, and the bottom of the first hinge 31 contacts the hinge base 38. When the first hinge 31 receives downward pressure, the hinge base 38 can support the first hinge 31.

Figure 9:
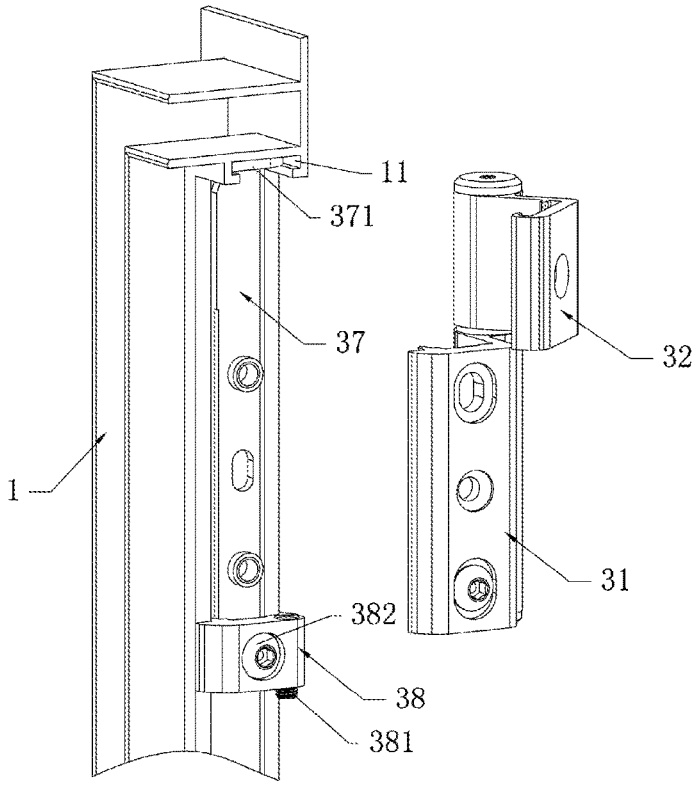
FIG. 9 is a schematic diagram of a three-dimensional structure when a hanger of a reinforcing part shown in 3 is latched into a slot of a window frame.

With reference to FIG. 9, to ensure that the reinforcing part 37 can be fixed on the window frame 1 more firmly, a hanger 371 is disposed on the top of the reinforcing part 37, the window frame 1 is provided with a slot 11, and the hanger 371 is latched into the slot 11

The hinge base 38 is provided with a threaded through-hole (not shown in the figure) in the vertical direction, and an up-down adjusting screw 381 goes through the threaded through-hole. The hinge base 38 and the reinforcing part 37 are pre-mounted on the window frame 1, and then the remaining hinge assembly 3 is connected to the casement sash 2; further, the hinge assembly 3 and the casement sash 2 are hung on the window frame 1.

The hinge assembly 3 further includes a first fastening part 391, a first left-right adjusting screw 392, and a fixing bracket 393. The first fastening part 391 is fixedly connected to the top of the casement sash 2, and the swing part 35 is connected to the first fastening part 391 by using the first left-right adjusting screw 392. The first fastening part 391 is provided with an embedded groove (not shown in the figure) in the horizontal direction. One end of the fixing bracket 393 is fixedly connected to the swing part 35, and the other end of the fixing bracket 393 goes through the embedded groove and is fixedly connected to the casement sash 2 by using a screw 394. After the hinge assembly 3 is mounted in a C-type slot on the top of the casement sash 2, the first fastening part 391 is first fastened on the casement sash 2 by using a screw 395.

To ensure that the casement sash 2 is more firm when it is open or that the casement sash 2 is more secure when it is closed, the second hinge 32 is also fixedly disposed at the bottom of the casement sash 2. Correspondingly, the first hinge 31 is also fixedly disposed on the window frame 1. The first hinge 31 and the second hinge 32 are hinged by using the pivot 33. To reinforce the first hinge 31, the first hinge 31 is fixedly connected to the lower edge of the window frame 1 by using the reinforcing part 37.

Figure 10:
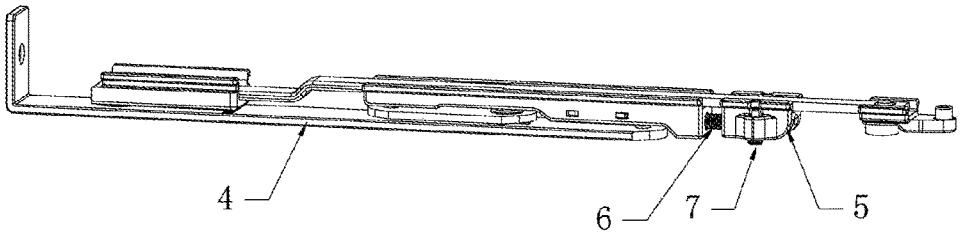
FIG. 10 is a schematic diagram of a three-dimensional structure after a support arm shown in FIG. 3 is connected to a second fastening part.

Further, with reference to FIG. 10, the top-hung casement window further includes a support arm 4, a second fastening part 5, and a second left-right adjusting screw 6. The second fastening part 5 is fixedly connected to the bottom of the casement sash 2, and the support arm 4 is fixedly connected to the second hinge 32 at the bottom of the casement sash 2. The support arm 4 is connected to the second fastening part 5 by using the second left-right adjusting screw 6. After the support arm 4 goes through the C-type slot of the casement sash 2, the second fastening part 5 is fixed on the casement sash 2 by using a screw 7.

After the whole casement sash 2 is mounted on the window frame 1, the up-down adjusting screw 381 is fastened to ensure that gaps between the upper edge and the lower edge of the casement sash 2 and the window frame 1 are even, thereby making it look more beautiful. Finally, the first hinge 31 is fixed on the window frame 1 by using the screw 382. The first left-right adjusting screw 392 and the second left-right adjusting screw 6 are adjusted to ensure that gaps between the left edge and the right edge of the casement sash 2 and the window frame 1 are even, thereby making it look more beautiful. Finally, the screw 396 and the screw 394 are fastened to fix the swing part 35 and the fixing bracket 393 on the top of the casement sash 2.

Figure 11:
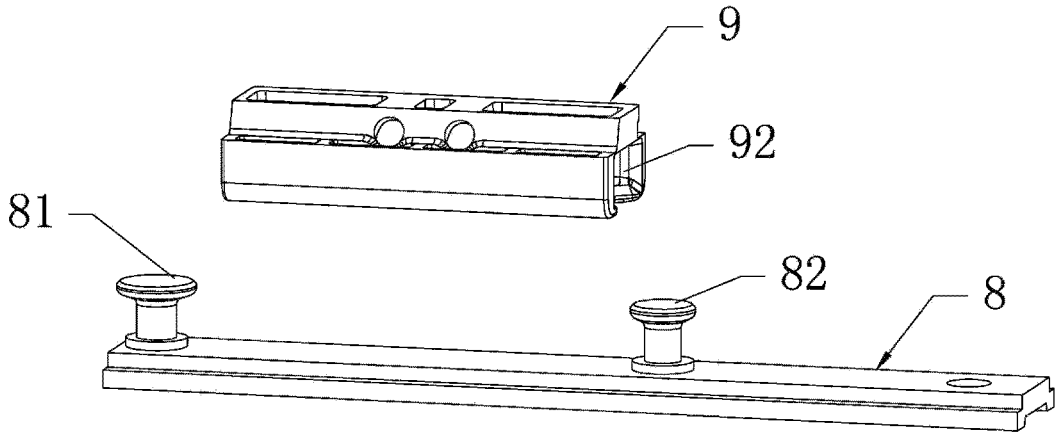
FIG. 11 is a schematic diagram of a breakdown structure of a lock base and a lock point shown in FIG. 3.

With reference to FIG. 11, the top-hung casement window further includes a lock lever 8 and a lock base 9, where the lock lever 8 is fixedly disposed on the top of the casement sash 2 and the lock base 9 is fixedly disposed on the window frame 1. A first latching knob 81 and a second latching knob 82 are extended up from the lock lever 8 and distributed at an interval; a first slot (not shown in the figure) and a second slot 92 are disposed at an interval on the lock base 9. When the casement sash 2 is open, the lock base 9 is located between the first latching knob 81 and the second latching knob 82. Therefore, the lock lever 8 does not contact the lock base 9 when the casement sash 2 is open. When the casement sash 2 is closed, the first latching knob 81 is latched into the first slot, the lock lever 8 is locked firmly by the lock base 9, and the casement sash 2 fixedly connected to the lock lever 8 cannot be open and top-hung or turned. In this case, the lock lever 8 and the lock base 9 can implement a locking function. When the casement sash 2 is top-hung, the second latching knob 82 is latched into the second slot 92. In this case, the lock lever 8 and the lock base 9 may serve as parts of the hung casement sash 2 to share the force of gravity of the casement sash 2 and fix the casement sash 2.

The foregoing descriptions are merely exemplary embodiments of the present invention, but are not intended to limit the present invention. Any modifications, equivalent replacements, or improvements made within the spirit and principle of the present invention shall fall within the protection scope of the present invention.

The invention claimed is:

1. A top-hung casement window, comprising a window frame and a casement sash and further comprising a hinge assembly, wherein the hinge assembly comprises a first hinge, a second hinge, a pivot, a connecting piece, a swing part, and a vertical limiting part, wherein: the first hinge comprises a first hinge portion and a first connecting portion, wherein the first hinge portion is disposed around the pivot, and the first connecting portion is fixedly connected to the window frame; the second hinge comprises a second hinge portion and a second connecting portion, wherein the second hinge portion is disposed around the pivot, and the second connecting portion is fixedly connected to the connecting piece; the vertical limiting part is provided with a fixing portion and a bearing portion; the swing part is provided with a through-hole and a groove; the bearing portion is embedded into the groove, and the fixing portion extends from the through-hole and is fixedly connected to the connecting piece; the swing part is capable of rotating around the bearing portion through the groove; and the swing part is fixedly connected to the top of the casement sash.

2. The top-hung casement window according to claim 1, wherein a shape of the bearing portion matches a shape of the groove.

3. The top-hung casement window according to claim 2, wherein the top surface of the bearing portion is an arc surface.

4. The top-hung casement window according to claim 2, wherein two grooves are provided at the bottom of the swing part, and the through-hole is provided at the bottom of each groove.

5. The top-hung casement window according to claim 1, wherein the connecting piece is L-shaped and comprises a horizontal portion and a vertical portion, wherein the horizontal portion is fixedly connected to the fixing portion of the vertical limiting part and the vertical portion is fixedly connected to the connecting portion of the second hinge.

6. The top-hung casement window according to claim 1, wherein the fixing portion of the vertical limiting part and the connecting piece are riveted.

7. The top-hung casement window according to claim 1, wherein the hinge assembly further comprises a first fastening part and a first left-right adjusting screw, wherein the first fastening part is fixedly connected to the top of the casement sash; and the swing part is connected to the first fastening part by using the first left-right adjusting screw.

8. The top-hung casement window according to claim 7, wherein the hinge assembly further comprises a fixing bracket; the first fastening part is provided with an embedded groove in a horizontal direction; one end of the fixing bracket is fixedly connected to the swing part; and the other end of the fixing bracket goes through the embedded groove and is fixedly connected to the casement sash by using a screw.

9. The top-hung casement window according to claim 1, wherein the hinge assembly further comprises a reinforcing part, wherein the reinforcing part is fixedly connected to the connecting portion of the first hinge and the top of the reinforcing part is fixedly connected to the window frame.

10. The top-hung casement window according to claim 9, wherein a hanger is provided on the top of the reinforcing part, and a slot is provided in the window frame, wherein the hanger is latched into the slot.

11. The top-hung casement window according to claim 1, wherein the hinge assembly further comprises a hinge base, wherein the hinge base is fixedly disposed on the window frame and contacts the bottom of the first hinge.

12. The top-hung casement window according to claim 11, wherein the hinge base is provided with a threaded through-hole in a vertical direction, and an up-down adjusting screw goes through the threaded through-hole.

13. The top-hung casement window according to claim 1, further comprising a lock lever and a lock base, wherein the lock lever is fixedly disposed on the top of the casement sash and the lock base is fixedly disposed on the window frame; a first latching knob and a second latching knob are extended up from the lock lever and distributed at an interval; a first slot and a second slot are disposed at an interval on the lock base; when the casement sash is open, the lock base is located between the first latching knob and the second latching knob; when the casement sash is closed, the first latching knob is latched into the first slot; and when the casement sash is top-hung, the second latching knob is latched into the second slot.

14. The top-hung casement window according to claim 1, wherein the second hinge is also fixedly disposed at the bottom of the casement sash; and correspondingly, the first hinge is fixedly disposed on the window frame, and the first hinge and the second hinge are hinged through the pivot.

15. The top-hung casement window according to claim 14, further comprising a support arm, a second fastening part, and a second left-right adjusting screw, wherein the second fastening part is fixedly connected to the bottom of the casement sash, and the support arm is fixedly connected to the second hinge at the bottom of the casement sash; and the support arm is connected to the second fastening part by using the second left-right adjusting screw.

* * * * *